US005625440A

United States Patent [19]

Matsumae et al.

[11] Patent Number: 5,625,440

[45] Date of Patent: Apr. 29, 1997

[54] DEVELOPING DEVICE HAVING SEALS BETWEEN A TONER TRANSPORT ROLLER AND THE TONER HOPPER WHICH PREVENT TONER LEAKAGE AND SCATTERING

[75] Inventors: Iwao Matsumae, Musashino; Kazuhiro Yuasa, Zama; Shuichi Endoh, Isehara; Yoshiaki Tanaka, Kawasaki; Hiroshi Hosokawa, Yokohama; Mugijiroh Uno, Isehara; Hiroshi Saitoh, Ayase; Eiji Takenaka, Isehara; Toshihiro Sugiyama, Atsugi; Tetsuo Yamanaka, Tokyo; Eisaku Murakami, Hiratsuka; Satoru Komatsubara, Atsugi, all of Japan

[73] Assignee: Ricoh Company, Ltd., Tokyo, Japan

[21] Appl. No.: 526,101

[22] Filed: Sep. 11, 1995

[30] Foreign Application Priority Data

Sep. 9, 1994 [JP] Japan ..... 6-240800

[51] Int. Cl.[6] ..... G03G 15/08

[52] U.S. Cl. ..... 399/272; 399/103

[58] Field of Search ..... 355/259, 215, 355/245; 118/653

[56] References Cited

U.S. PATENT DOCUMENTS

| | | | |
|---|---|---|---|
| 5,075,728 | 12/1991 | Kobayashi et al. | 355/245 X |
| 5,124,753 | 6/1992 | Asai et al. | 355/259 |
| 5,212,521 | 5/1993 | Ogawa et al. | 355/215 |
| 5,486,909 | 1/1996 | Takenaka et al. | 355/259 |
| 5,488,462 | 1/1996 | Ishikawa et al. | 355/215 |
| 5,502,547 | 3/1996 | Shirai | 355/215 |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

A developing device which includes a first toner transporting roller, a second toner transporting roller to which toner is transported from the first toner transporting roller and an image bearing member such as a photoconductive drum or belt. Seals are located between the circumferential ends of one of the toner transporting rollers and a bottom portion of a toner hopper. When the seals are between the bottom of toner hopper and the first toner transporting roller, the first toner transporting roller is longer than the second toner transporting roller and the circumferential portions of the first toner transporting roller which contact the seals do not contact the second toner transporting roller. Alternatively, when the seals are between the bottom of toner hopper and the second toner transporting roller, the second toner transporting roller is longer than the first toner transporting roller and the circumferential portions of the second toner transporting roller which contact the seals do not contact the first toner transporting roller. Additionally, when the seals contact the second toner transporting roller, side seals may be placed against the ends of the first toner transporting roller. In both of these arrangements, the length of the second toner transporting roller is shorter than a length of an effective area of a photoconductive layer on the image bearing member.

9 Claims, 6 Drawing Sheets

FIG. 7
PRIOR ART
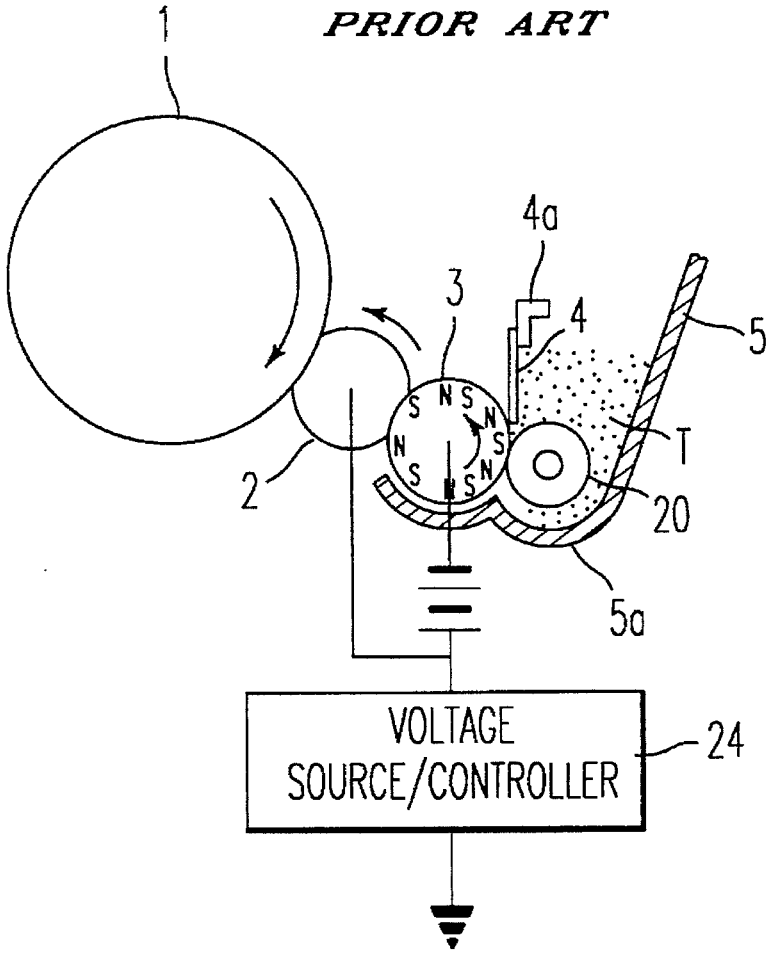
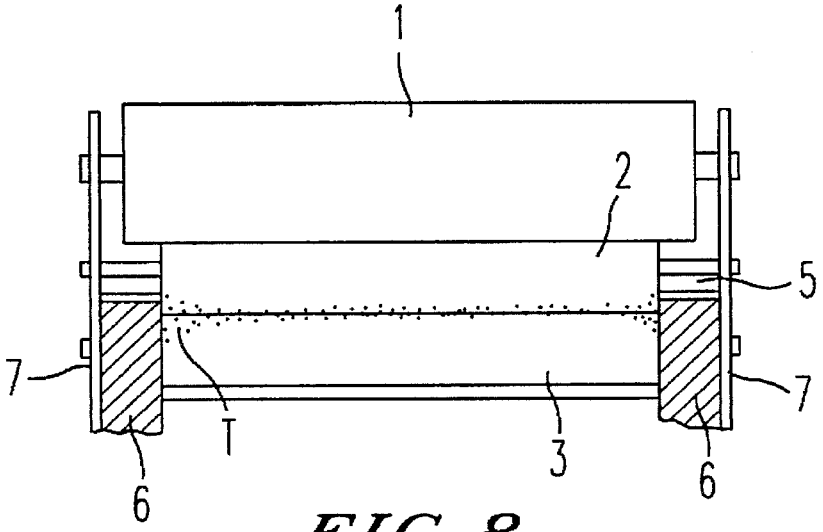
FIG. 8
PRIOR ART

DEVELOPING DEVICE HAVING SEALS BETWEEN A TONER TRANSPORT ROLLER AND THE TONER HOPPER WHICH PREVENT TONER LEAKAGE AND SCATTERING

BACKGROUND OF THE INVENTION

1. Field of the Invention

This invention relates to a developing device which is used in an image forming apparatus such as a copying machine, plotter, laser printer or facsimile machine. The invention further relates to the use of a seal which prevents toner from leaking and scattering.

2. Discussion of the Background

A conventional two step type of a developing device is shown in FIG. 7. The developing device includes an image bearing member 1 (e.g., a photosensitive drum), a first toner transporting roller 3, and a second toner transporting roller 2 which is provided between the image bearing member 1 and the first toner transporting roller 3. The first toner transporting roller 3 has a magnetic field generating layer which holds toner on the surface thereof. Additionally, there is a toner supplying roller 20 in contact with the first toner transporting roller 3.

There is a doctor blade 4 in contact with the first toner transporting roller 3. At a bottom portion of a developing hopper 5, there is a section 5*a* for storing and catching toner which extends under a lower side of the first toner transporting roller 3. A thickness of toner T which is held on the first toner transporting roller 3 is controlled by the doctor blade 4 which also charges the toner T using friction. The second toner transporting roller 2 is an elastic roller having a dielectric layer on its surface and is in contact with both the first toner transporting roller 3 and the image bearing member 1 so that predetermined contacting areas are formed on the rollers 2 and 3 and on the image bearing member 1.

The toner T is transferred from the first toner transporting roller 3 to the second toner transporting roller 2 by a bias voltage which is applied to the first toner transporting roller 3 using a voltage source/controller 24. The toner T which is transferred from the first toner transporting roller 3 is transferred from the second toner transporting roller 2 to a latent image on the image bearing member 1 which has been formed by a latent image forming device (not shown).

As shown in FIG. 8, to prevent toner from leaking, spilling out or scattering from the developing hopper in a two step type of a developing device, seals 6 are provided between the ends of the first toner transporting roller 3 and sides 7 of the developing hopper. However, as shown in FIGS. 9 and 10, there are slight non-contact portion(s) between the first toner transporting roller 3 and the second toner transporting roller 2; that is gaps A and A'. The collected toner gets in between the ends of the first toner transporting roller 3 and the sides and falls to the bottom portion 5*a* of the developing hopper from the gaps A and A' due to the rotation of the first toner transporting roller 3.

Further, since an agitator is provided in the developing hopper 5, toner flows out of and scatters around the developing hopper. Such seals 6 cannot effectively prevent toner from flowing out, spilling out, or scattering from the gaps A and A'.

SUMMARY OF THE INVENTION

The present invention has an object to overcome the above and other problems encountered in the aforementioned art. It is a further object of the present invention to provide a developing device capable of preventing toner from flowing out, spilling out and scattering.

The above-mentioned objects of the present invention are achieved by a two step type of developing device which includes a first toner transporting roller, and a second toner transporting roller to which toner is transported from the first toner transporting roller. The length of the second toner transporting roller is shorter than a length of an effective area of a photoconductive layer of image bearing member such as a photoconductive drum or belt. Also, the length of the first toner transporting roller is longer than the length of the second toner transporting roller.

The developing device further includes a developing hopper having a bottom portion which extends under the first toner transporting roller and has end surface seals on a peripheral surface of the ends of the first toner transporting roller which do not contact the second toner transporting roller. The seals are located between the bottom portion of the developing hopper and the first toner transporting roller, and contact the sides of the hopper. The rollers are arranged such that the ends of the first toner transporting roller which contact the seals do not contact the second toner transporting roller.

In a modified embodiment of the invention, the first toner transporting roller is shorter in length than the second toner transporting roller. The bottom portion of the developing hopper further extends under the second toner transporting roller and the seals are located between the second toner transporting roller and bottom portion of the toner hopper. Also, there are end surface seals which are provided on the peripheral surface of the ends of the first toner transporting roller.

BRIEF DESCRIPTION OF THE DRAWINGS

Other objects and further features of the present invention will become apparent from the following detailed description when read in conjunction with the accompanying drawings, wherein:

FIG. 7 is a cross-sectional view of a two step type of a developing device according to the prior art; and FIGS. 8–10 illustrate various toner scattering problems of prior art devices.

DESCRIPTION OF THE PREFERRED EMBODIMENTS

Figure 1:
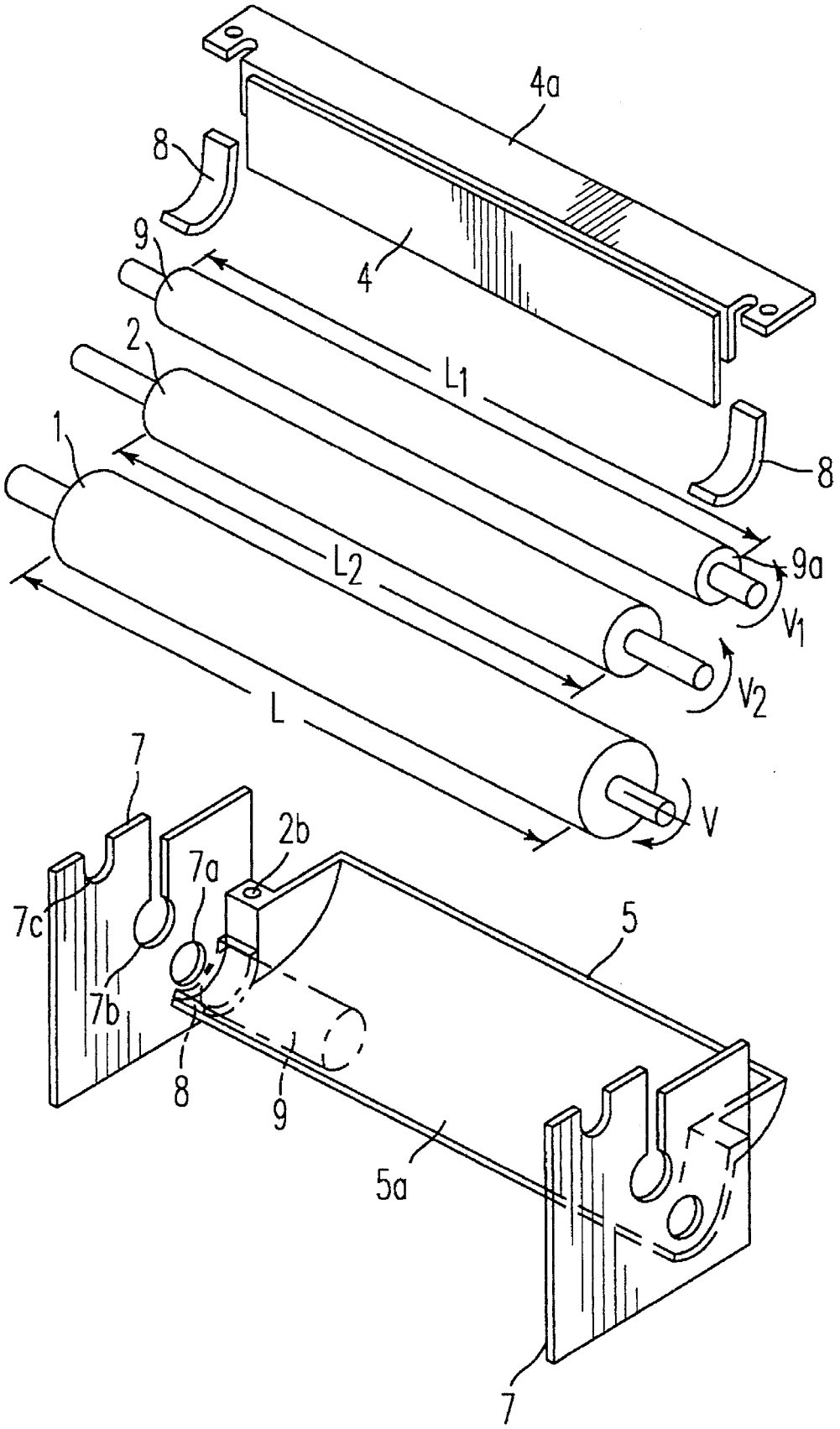
FIG. 1 is a perspective view of a two step type of a developing device according to the first embodiment of the present invention.

Referring now to the drawings, wherein like reference numerals designate identical or corresponding parts throughout the several views, and more particularly to FIG. 1 thereof, there is illustrated a perspective view of a two step type of a developing device according to the first embodiment of the present invention. A latent image is formed on an image bearing member 1 by an optical writer such as a laser or other device. A surface of a second toner transporting roller 2 is in contact with the image bearing member 1 and transfers toner T onto a latent image on the image bearing member 1. The length of the first toner transporting roller 9 is longer than the length of the second toner transporting roller 2. Further, the length of the second toner transporting roller 2 is shorter than that of an effective portion of a photoconductive layer of the image bearing member 1 and is longer than a width of the widest paper sheets which are used in a machine. The second toner transporting roller 2 is in contact with a first toner transporting roller 9 and transfers toner T on a latent image of the image bearing member 1. The effective portion of the photoconductive layer is the portion on which images are (or can be) formed. The first toner transporting roller 9 is in contact with the second toner transporting roller 2 and transfers toner T onto the second toner transporting roller 2.

A speed V1 of the outer surface of the first toner transporting roller 9 is faster than a speed V2 of the outer surface of the second toner transporting roller 2 which is faster than a speed V of the outer surface of the image bearing member 1 such that the following relationship is satisfied:

$$V1>V2>V \quad (1)$$

A doctor blade 4 controls a thickness of toner on the first toner transporting roller 9. A developing hopper 5 receive toner from a toner supplying tank (not shown) and supplies the toner onto the first toner transporting roller 9. The developing hopper 5 has a bottom portion 5*a* which serves as a toner storing portion which catches and stores toner. A pair of side boards 7 are formed with and connected to the developing hopper 5. On the side boards, there are pairs of holes 7*a*, 7*b* and members 7*c* which hold bearings for the first toner transporting roller 9, the second toner transporting roller 2, and the image bearing member 1, respectively.

End portion seals 8 cover part of peripheral surfaces of end portions of the first toner transporting roller 9. The doctor blade 4 is formed so as to cover part of the upper portion of the developing hopper 5 to prevent toner from leaking out of the hopper 5. The blade holder 4*a* to which the blade 4 is mounted is secured to the hopper 5 by using bolts which are inserted into the holes 26. The remaining portion of the upper portion of the developing hopper 5 is covered by part of the toner supplying tank (not shown).

Figure 2:
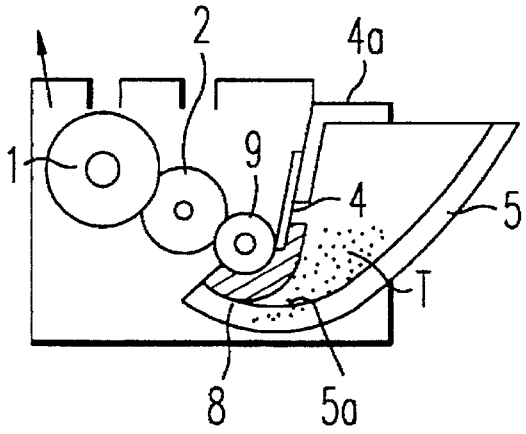
FIG. 2 is a cross-sectional view of the first embodiment of the present invention.

FIG. 2 is a cross-sectional view of the first embodiment illustrated in FIG. 1. The first toner transporting roller 9 is located in the lowest portion and the second toner transporting roller 2 is provided diagonally upward and to the left of the first toner transporting roller 9. The image bearing member 1 is diagonally upward and to the left of the second toner transporting roller 2. The bottom portion 5*a* of the developing device 5 is located under the first toner transporting roller 9. The end portion seals 8 are provided so as to cover between the peripheral surfaces of the end portions of the first toner transporting roller 9 and the bottom portion 5*a* of the developing device 5.

Figure 3:
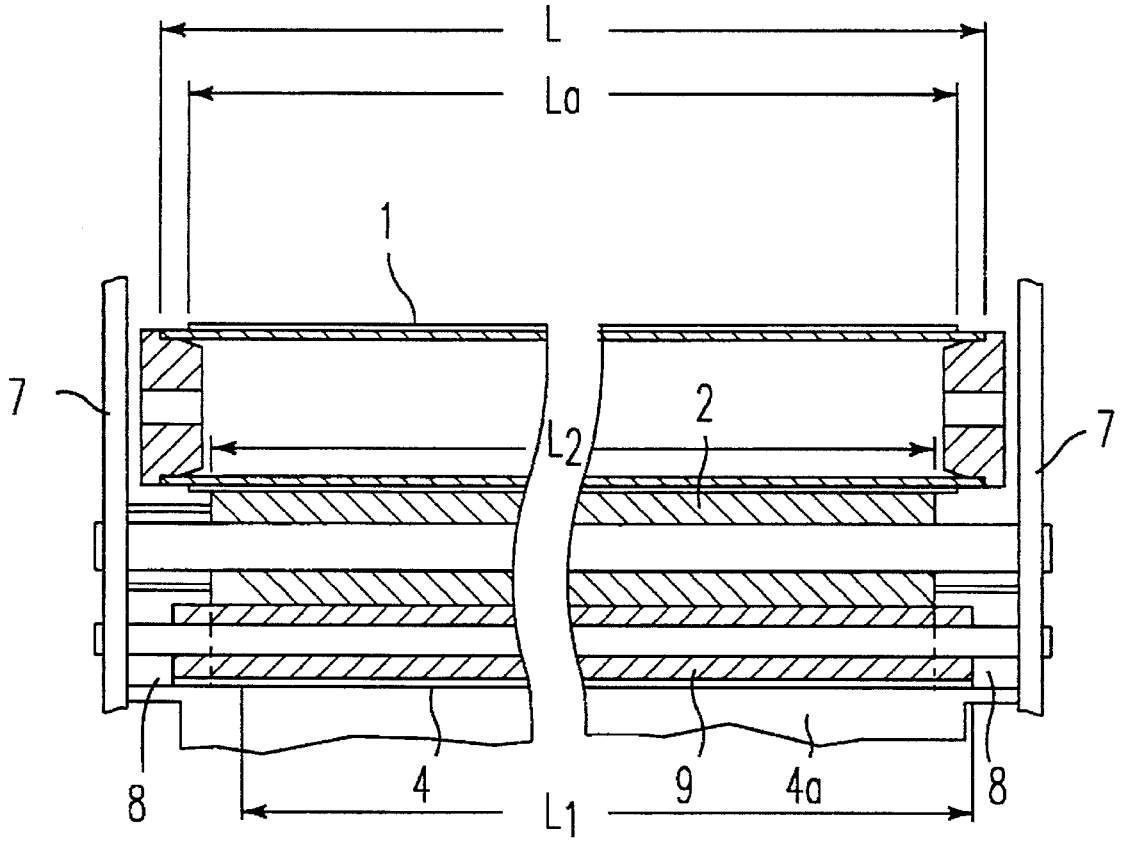
FIG. 3 is another view of the first embodiment of the present invention.

FIG. 3 is another view of the invention illustrated in FIGS. 1 and 2. In FIG. 3, the relationships of a length L of the image bearing member 1, a length La of the photoconductive layer, the length L1 of the first toner transporting roller 9 and the length L2 of the second toner transporting roller 2 are shown. The length L2 is longer than a width of the widest paper sheets which are used in the machine. Further, the length L1 is greater than the length L2. Additionally, it is seen that the seals 8 contact portions of the first toner transport roller 9 which do not contact the second toner transport roller 2.

The arrangement of the system illustrated in FIGS. 1–3 makes it possible to prevent toner which could not be transferred onto the second toner transporting roller 2 and was moved gradually toward both ends (that is, toner stored around end portions of the nip between the first and second toner transporting roller 2 and 9) from spilling from end portions 9*a* of the first toner transporting roller 9. Since the end portion seals 8 cover part of the peripheral surfaces of end portions of the roller 9 and the end portion seals 8 reach the side boards 7, and further the end portion seals 8 are located between the bottom portion 5*a* of the developing hopper 5 and the peripheral surfaces of the end portions of the first toner transporting roller 9, it is possible to prevent gaps A and A' in the conventional device from being formed and also prevent toner in the developing hopper 5 from flowing out or scattering.

Figure 4:
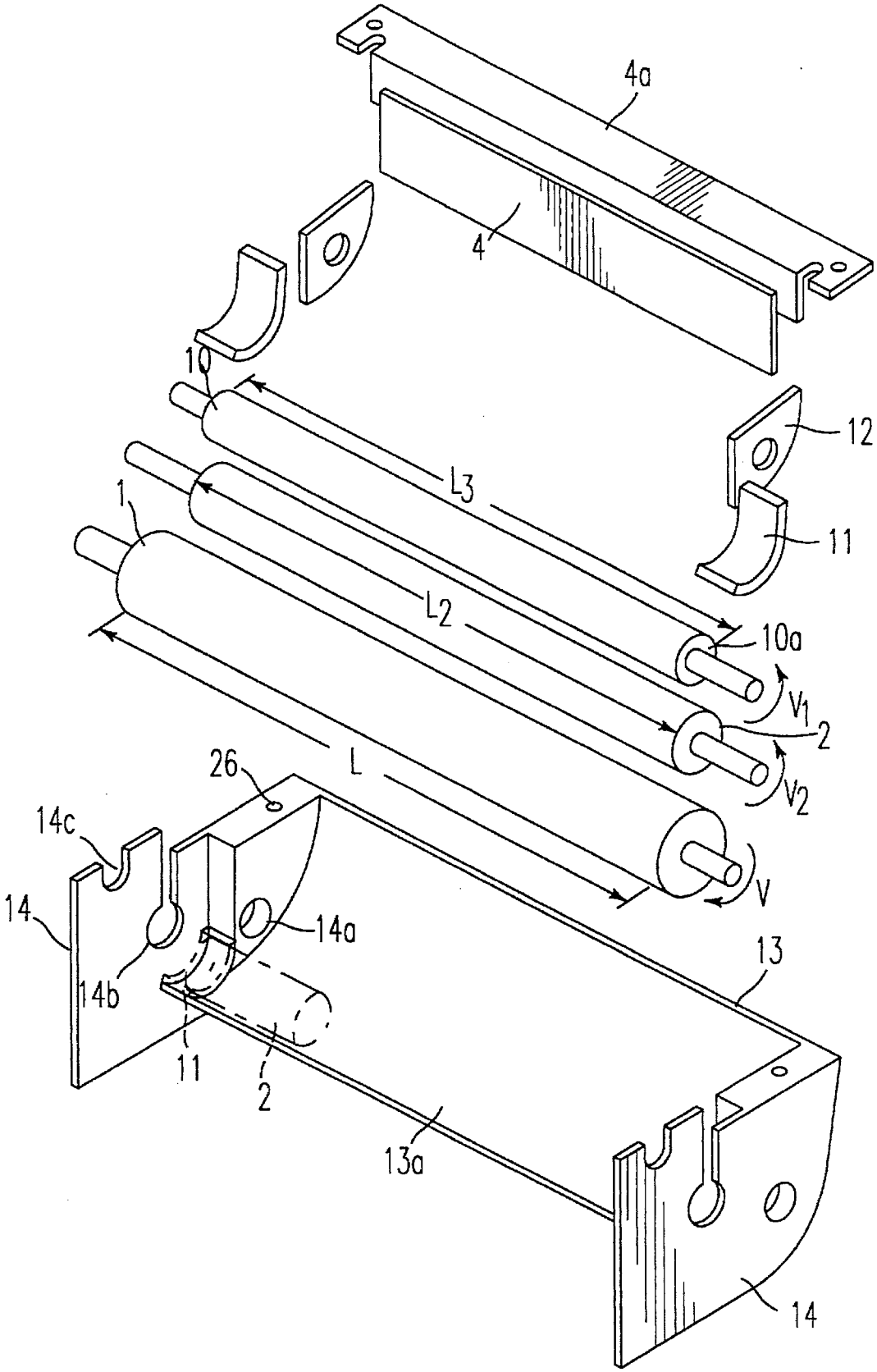
FIG. 4 is a perspective view of a two step type of a developing device according to the second embodiment.

FIG. 4 is a perspective view of a two step type of a developing device according to the second embodiment. In FIG. 4, a length L3 of a first toner transporting roller 10 is shorter than a length L2 of a second toner transporting roller 2. End portion seals 11 cover parts of peripheral surface of end portions of the second toner transporting roller 2. Side seals 12 cover side portions of the first toner transporting roller 10. A bottom portion 13*a* of a developing hopper 13 extends under the second toner transporting roller 2. A pair of side boards 14 are formed and connected to the developing hopper 13. A pair of bearing holes 14*a*, a pair of bearing fixing holes 14*b* and a pair of bearing supporting members 14*c* are formed on the side boards 14.

The end portion seals 11 are in contact with side surfaces 10*a* of the first toner transporting roller 10 and the side seals 12. Also, the end portion seals 11 are provided so as to cover parts of the peripheral or outer circumferential surfaces of end portions of the second toner transporting roller 2. It is possible to prevent toner from spilling out of edges of both end portions of the second toner transporting roller 2 and also to dam up remaining toner on end portions around the nip portion of the first and second toner transporting rollers 2 and 10. The remaining toner is toner that could not be transferred onto the second toner transporting roller 2 and moved toward the end portions. Accordingly, it is possible to prevent remaining toner from spilling out and to reduce the remaining toner.

Figure 5:
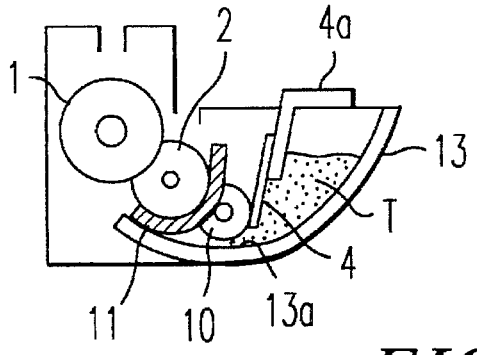
FIG. 5 is a cross-sectional view of the second embodiment of the present invention.

FIG. 5 is a cross-sectional view of the second embodiment illustrated in FIG. 4. In FIG. 5, the first toner transporting roller 10 is located in the lowest portion and the second toner transporting roller 2 is provided diagonally upward and to the left of the first toner transporting roller 10 and the image bearing member 1 is disposed diagonally upward and to the left of the second toner transporting roller 2. The bottom portion 13*a* of the developing hopper 13 is located under the second toner transporting roller 2 so as to receive the first and second toner transporting rollers 2 and 10. The end portion seals 11 are provided between the peripheral surfaces of the end portions of the first toner transporting roller 10 and the bottom portion 13*a* of the developing hopper 13.

Figure 6:
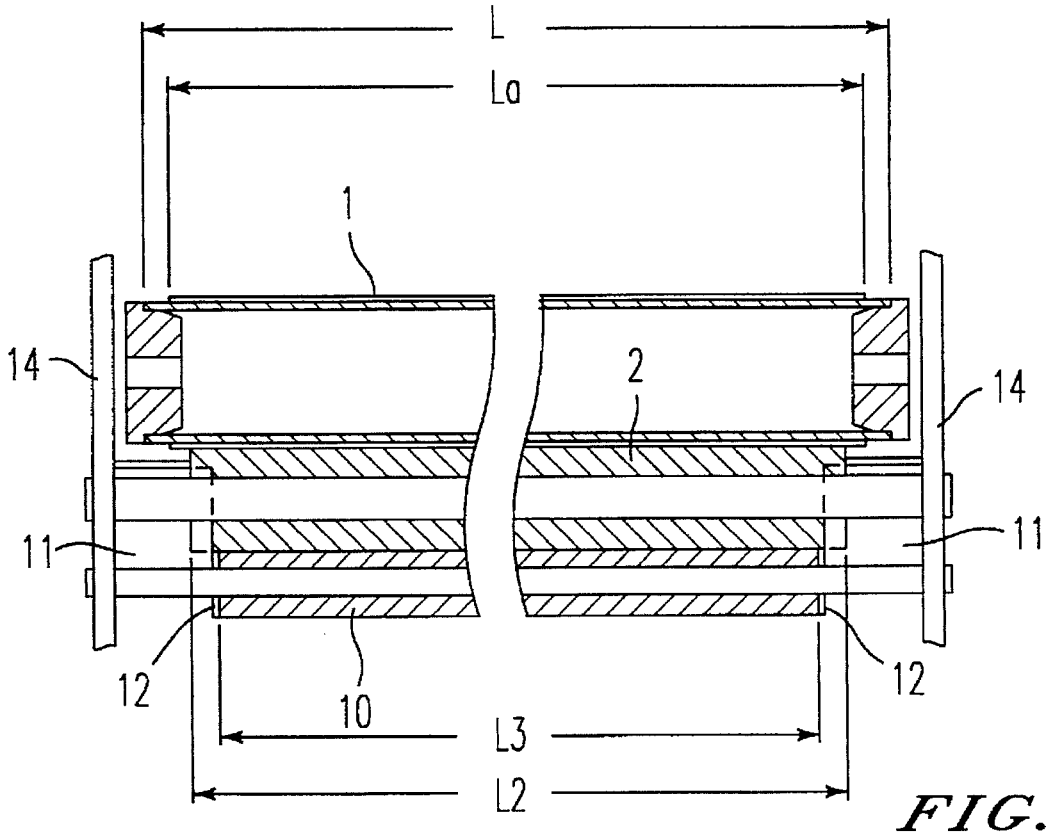
FIG. 6 is another view of the second embodiment of the present invention.
Figure 9:
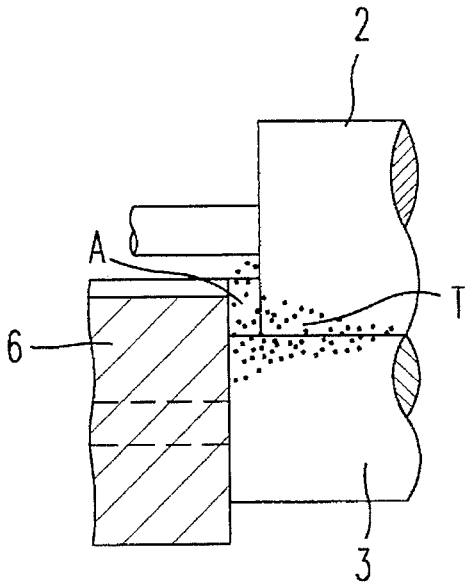
FIG. 9 PRIOR ART
Figure 10:
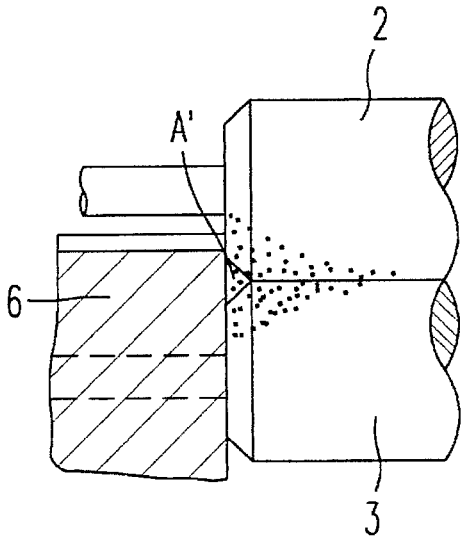
FIG. 10 PRIOR ART

FIG. 6 is another view of the second embodiment illustrated in FIGS. 4 and 5 and shows the relationships of the length L of the image bearing member 1, the length La of photoconductive layer, the length L2 of the second toner transporting roller 2, and a length L3 of the first toner transporting roller 10. In FIG. 6, it is seen that the first toner transporting roller 10 does not contact the second toner transporting roller 2 where the roller 2 contacts the seals 11.

Since a peripheral speed of the second toner transporting roller 2 is slower than that of the first toner transporting roller 10, and end portion seals are provided on the second toner transporting roller 2, it is possible to reduce frictional resistance. Therefore, it is possible to improve durability of the end portion seals.

In the second embodiment, the end portion seals 11 cover the peripheral surfaces of end portions of the second toner transporting roller 2 to the side boards 14. As a result, the end portion seals 11 are provided between the peripheral surface of the end portions and the bottom portion 13*a* of the developing hopper 13. Accordingly, it is possible to prevent gaps A and A' in the conventional devices from being formed and toner in the developing hopper 13 from spilling out or scattering.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A developing device for use with an image forming system, comprising:

a first toner transporting roller having two ends;

a second toner transporting roller in contact with the first toner transporting roller which transports toner from the first toner transporting roller;

an image forming member which receives transported toner from the second toner transporting roller;

a toner hopper having a bottom portion which extends under the first toner roller;

side supports which rotatably support the first toner transporting roller, the second toner transporting roller, and the image forming member; and a seal at each of the ends of the first toner transporting roller disposed between an outer circumferential portion of the first toner transporting roller and the bottom portion of the toner hopper.

2. A developing device according to claim 1, wherein the seals at each of the ends of the first toner transporting roller contact corresponding ones of the side supports.

3. A developing device according to claim 1, wherein:

a length of the first toner transporting roller is longer than a length of the second toner transporting roller.

4. A developing device according to claim 3, wherein:

a portion of the first toner transporting roller which contacts a corresponding one of said seals does not contact the second transporting roller.

5. A developing device according to claim 4, wherein:

a length of the second toner transporting roller is shorter than a length of an effective area of a photoconductive layer of the image forming member.

6. A developing device according to claim 1, wherein:

the seal at each of the ends of the first toner transporting roller contacts the outer circumferential portion of the first toner transporting roller.

7. A developing device for use with an image forming system, comprising:

a first toner transporting roller having two ends;

a second toner transporting roller in contact with the first toner transporting roller which transports toner from the first toner transporting roller, the second toner transporting roller having two ends;

an image forming member which receives transported toner from the second toner transporting roller;

a toner hopper having a bottom portion which extends under the second toner transporting roller;

side supports which rotatably support the first toner transporting roller, the second toner transporting roller, and the image forming member; and a seal at each of the ends of the second transporting roller disposed between an outer circumferential portion of the second toner transporting roller and the bottom portion of the toner hopper, wherein a length of the second toner transporting roller is shorter than a length of an effective area of a photoconductive layer of the image forming member.

8. A developing device according to claim 7, further comprising:

seals contacting the two ends of the first toner transporting roller.

9. A developing device according to claim 7, further comprising:

seals contacting the two ends of the first toner transporting roller.

* * * * *